United States Patent [19]

Salzer

[11] Patent Number: 4,596,482

[45] Date of Patent: Jun. 24, 1986

[54] LABEL FORMING DEVICE FOR COMB BINDING

[76] Inventor: Willard M. Salzer, 10 Red Oak La., Norwalk, Conn. 06850

[21] Appl. No.: 715,647

[22] Filed: Mar. 25, 1985

[51] Int. Cl.[4] ..... B42F 13/10

[52] U.S. Cl. ..... 402/3; 281/36

[58] Field of Search ..... 402/3, 19; 281/21 R, 281/21 A, 25 R, 25 A, 36; 40/10 R, 10 D, 16, 16.2, 16.4

[56] References Cited

U.S. PATENT DOCUMENTS 1,571,479 2/1926 Huber ..... 402/3

1,691,257 8/1926 Smith ..... 402/3

2,239,081 3/1939 Cooper et al. ..... 281/36

3,335,508 8/1967 Hummel ..... 402/3

*Primary Examiner*—Paul A. Bell

*Attorney, Agent, or Firm*—Freilich, Hornbaker, Rosen & Fernandez

[57] ABSTRACT

A backing for quickly and inexpensively affixing a title label to a comb binding without special equipment to yield a neat professional looking product. The backing is preferably comprised of a transparent U-shape strip secured to the comb binding and a U-shape label strip adapted to be retained between the backing strip and comb binding spine.

5 Claims, 12 Drawing Figures

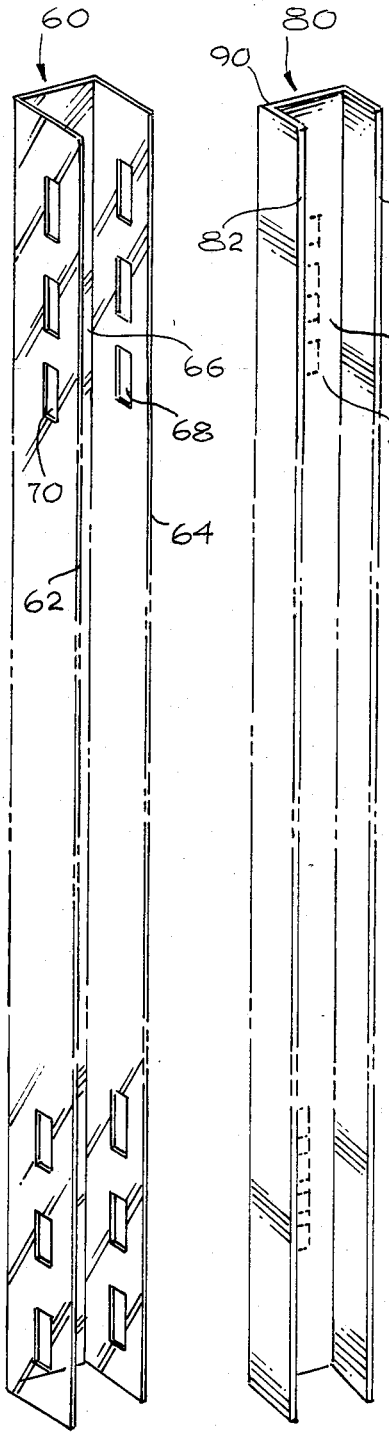
Fig. 1C
Fig. 1B
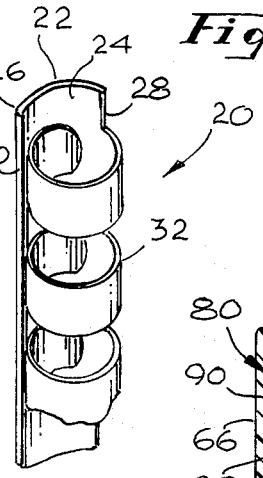
Fig. 1A
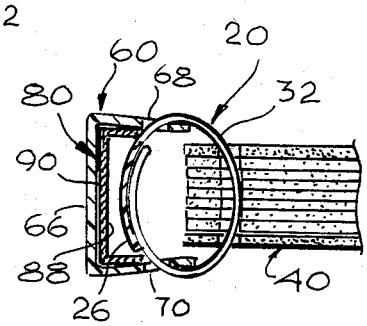
Fig. 3
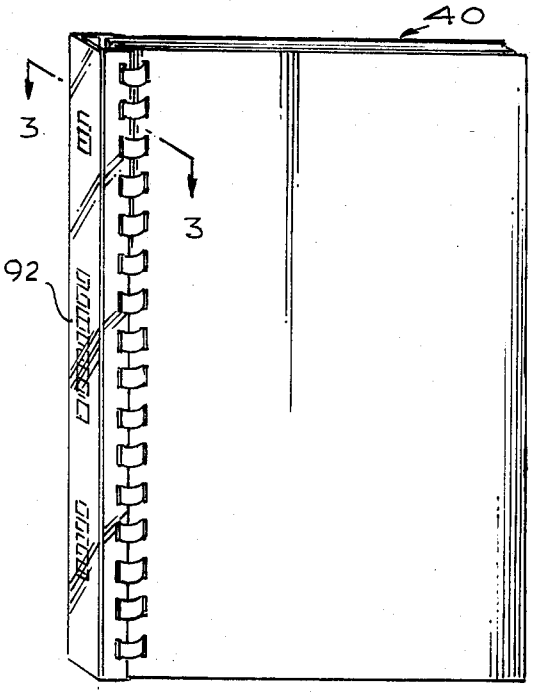
Fig. 2

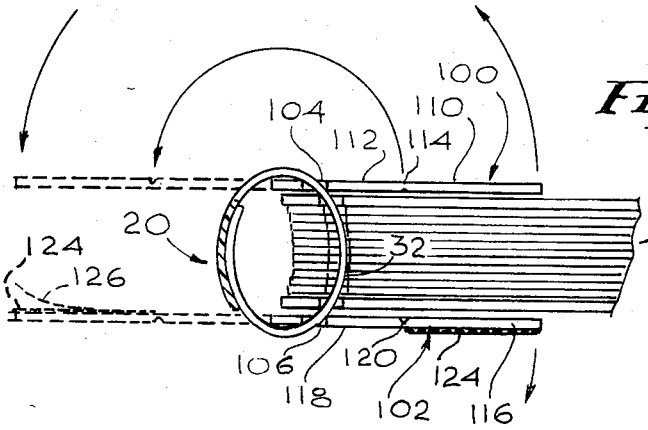
Fig. 4A
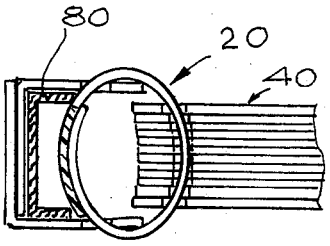
Fig. 4C
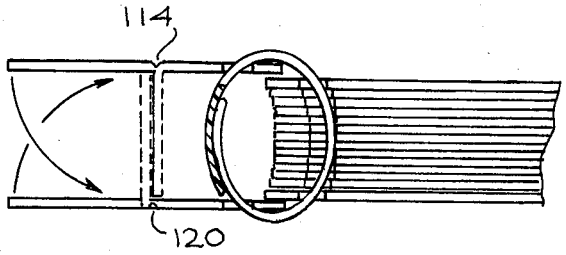
Fig. 4B
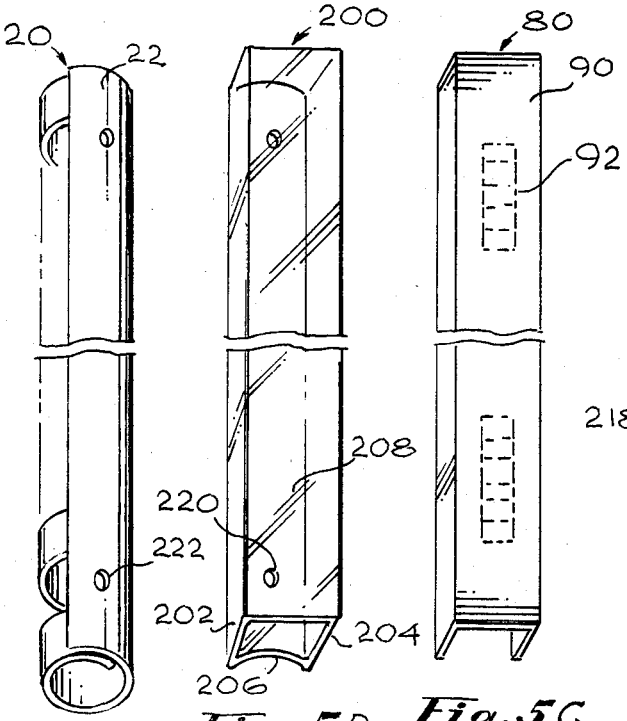
Fig. 5A
Fig. 5B
Fig. 5C
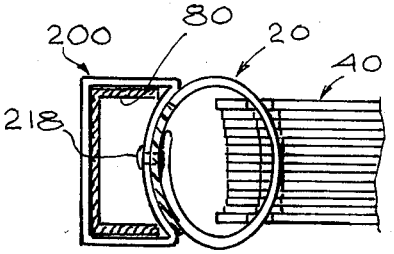
Fig. 6

LABEL FORMING DEVICE FOR COMB BINDING

FIELD OF THE INVENTION

This invention relates generally to means for affixing a full length label to a comb binding used to bind together a plurality of separate sheets of paper in book form.

BACKGROUND OF THE INVENTION

Comb bindings are widely used for retaining a plurality sheets of paper together in book form. Such bindings consist of an elongated plastic spine having a plurality of integral fingers projecting from a first edge of the spine. The fingers are flexible and are set so as to curl from said first edge back toward the second edge of the spine with the finger free ends overlapping said second spine edge. Thus, in cross section, the fingers and spine form an essentially closed curve; e.g. circle or oval.

By threading the fingers through aligned apertures formed in a stack of paper sheets (or "leaves"), the sheets can be neatly retained together in book form with the spine running along the rear edge of the sheet stack.

Because comb bindings are inexpensive, are available in a range of sizes, and can be readily installed, either manually or with simple equipment, in a typical office environment they are widely used to provide professional looking reports.

However, one significant factor mitigating against the use of comb bindings is that there has been no quick and inexpensive way to label the spine rear face so that individual reports can be readily distinguished when, for example, placed in a book case. Of course various attempts have been made to avoid this problem by, for example, adhering a label directly to the spine or hanging a label holder over one end of the spine. Unfortunately, these efforts have not yielded satisfactory professional looking bindings. Although efforts to print titles directly onto the spine have been successful, this approach is practical only when a large number of bindings are to be identically labeled and where sufficient lead time is available.

The following patents are exemplary of prior techniques for applying labels to bindings U.S. Pat. Nos.:

1,843,542; Dawson
2,576,783; Dewey
3,335,508; Hummel
3,335,510; Littler
3,544,230; Ohlsson
3,663,041; White
3,807,883; Karlsson
3,814,527; Lawes.

SUMMARY OF THE INVENTION

The present invention is directed to a backing for quickly and inexpensively affixing a title label to a comb binding, without special equipment, to yield a neat professional looking product.

A backing device is provided in accordance with the preferred embodiment which includes a transparent elongated backing strip adapted to be secured to a comb binding spine and an elongated label strip adapted to be retained between the spine and the backing strip.

In accordance with the preferred embodiment, the elongated transparent backing strip is formed from flat stock into a U-shape member having first and second legs and a cross piece. The legs contain apertures adapted to be threaded by the comb binding fingers to secure the backing strip to the comb binding spine.

The elongated label strip is preferably also formed from flat stock into a U-shape member also having first and second legs and a cross piece. The title can be readily typed onto the cross piece and the label strip then inserted between the U-shape backing strip and the comb binding spine.

In accordance with a first alternative embodiment, the backing strip is formed from two separate transparent strips which can be installed by respectively placing them on the top and bottom of the stack of paper sheets and threading them with the comb binding fingers. The separate strips are then overlapped and adhered together to form the backing strip.

In accordance with a still further embodiment, the backing strip is attached directly to the binding spine, as by rivets or adhesive, rather than by threading the binding fingers through apertures in the backing strip.

The novel features of the invention are set forth with particularity in the appended claims. The invention will be best understood from the following description when read in conjunction with the accompanying drawings.

BRIEF DESCRIPTION OF THE DRAWINGS

FIG. 1A is an isometric view illustrating a portion of a conventional comb binding;

FIGS. 1B and 1C are isometric views respectively illustrating a label strip and transparent backing strip in accordance with the invention intended to be mounted on the comb binding of FIG. 1A;

FIG. 2 is an isometric view depicting the comb binding and label and backing strips of FIGS. 1A, 1B, and 1C in association with a stack of sheets to form a book;

FIG. 3 is a sectional view taken substantially along the plane 3—3 of FIG. 2;

FIGS. 4A and 4B are plan views showing the manner of installing a first alternative backing strip embodiment comprised of separate strip members;

FIG. 4C is a plan view of the embodiment of FIGS. 4A and 4B showing the label strip installed between the backing strip and comb binding;

FIG. 5A is an isometric view of a conventional comb binding;

FIG. 5B is an isometric view depicting a further alternative backing strip embodiment in accordance with the invention;

FIG. 5C is an isometric view of a label strip intended to be used with the backing strip of FIG. 5B; and FIG. 6 is a plan view of the embodiment of 5A, 5B, and 5C showing it installed on a stack of paper sheets.

DESCRIPTION OF EXEMPLARY EMBODIMENTS

Attention is initially directed to FIG. 1A which depicts a conventional comb binding 20. Comb binding 20 is comprised of an elongated plastic spine 22 having a front face 24 and a rear face 26. The elongated spine 22 additionally has first and second edges 28 and 30.

A plurality of spaced fingers 32 extend laterally outward from the spine edge 28 and curl toward the second edge 30, overlapping the spine front face 24, as is best depicted in FIGS. 1A and 3.

The fingers 32 are flexible and, as is well known, can be uncurled manually or by the use of commercially available mechanisms, in order to thread the fingers through aligned apertures formed in a stack of paper sheets 40, as is depicted in FIG. 3.

Comb bindings 20 are well known in the art and are readily commercially available for binding together a stack of sheets 40 in book form. Although such comb bindings have proved to be very useful to produce reports in book form, there has been no effective way of applying titles to the spine rear face 26 to enable a report so bound to be readily distinguished when placed in a bookcase, for example. The present invention is directed to an effective means for applying full length labels to the rear face of the comb binding. It is pointed out that the present invention is intended primarily for use in the typical office environment for relatively small numbers of binders where silk screening the title directly to the spine rear face is impractical either because of short lead times, small runs, or low budget objectives.

In accordance with the present invention, an elongated backing strip 60 of transparent plastic material is provided. The backing strip 60 is preferably formed from flat stock into a U-shape cross-section including first and second legs 62,64 and a bight member or cross-piece 66. The legs 62,64 have aligned apertures 68,70 formed therein spaced along the strip 60 in a manner corresponding to the spacing of the fingers on the comb binding 20. In accordance with the invention, as depicted in FIGS. 1–3, the backing strip 60 is retained on the comb binding 20 by threading the fingers 32 through the apertures 68,70.

An elongated label strip 80, depicted in FIG. 1B, is provided for insertion between the backing strip 60 and the comb binding 20. The label strip 80 is preferably also formed from flat stock into a U-shape cross-section including legs 82,84 and a bight member or cross-piece 86. Cross-piece 86 has front and rear faces 88,90. It is intended that a user type a title (indicia 92) on the rear face 90 of the label strip 80 so that when the label strip is inserted, as depicted in FIG. 3, between the backing strip 60 and the comb binding 20, the title will be visible through the cross-piece 66 of the backing strip 60.

When the backing strip 60 and label strip 80 are installed on the comb binding 20, they provide a report with a neat professional looking appearance, as is best depicted in FIG. 2.

The backing strip 60 of FIG. 1C is installed on the comb binding 20 by threading the fingers 32 through the apertures in the backing strip legs 62,64. This operation can be performed manually or, at least partially, by standard commercially available equipment. More particularly, machines are commercially available which enable the fingers of comb binding 20 to be threaded through a stack of sheets 40. These machines essentially operate by clamping the spine 22 and then uncurling the fingers 32 to enable a stack of apertured sheets to be placed immediately over the uncurled fingers. As the machine then releases the fingers, the fingers curl up through the apertures in the sheet stack. This same machine and technique can be utilized to thread the comb binding fingers 32 through the apertures in backing strip leg 64 by placing it immediately adjacent one end of the stack 40.

Attention is now directed to an alternative embodiment of the invention depicted in FIGS. 4A, 4B, and 4C. The embodiment of FIGS. 4A–C is similar to that depicted in FIGS. 1–3 except that the backing strip 60 is formed of two separate strips 100,102. More particularly, FIG. 4A shows two transparent elongated strips 100,102 which are respectively apertured at 104,106. These strips 100,102 can be placed on the top and bottom of the stack of sheets 40 prior to installation of the comb binding. Thus, when the strips 100,102 are respectively placed on the top and bottom of the stack of sheets 40, the fingers 32 of the comb binding 20 can be threaded through both the apertures in the stack and the apertures 104,106 in the strips 100,102 in the same operation, either manually or by use of existing machines.

With the strips 100,102 first threaded as depicted in solid line in FIG. 4A, they can then be flipped back to the dashed line also position depicted in FIG. 4A.

The strip 100 is essentially comprised of two portions 110 and 112, preferably separated by a preformed fold line 114. Similarly the strip 102 is comprised of two portions 116 and 118, also separated by a fold line 120.

One face of the strip portion 116 is preferably coated with a releasable adhesive 124 which, prior to use, is protected by a peel-away paper 126.

With the first and second strips 100,102 flipped to the dashed line position in FIG. 4A, they respectively can be folded along the fold lines 114,120 into L-shape members as depicted in FIG. 4B. The protective paper 126 can then be peeled away to thus permit the adhesive layer 124 on strip 102 to overlap and adhere to portion 110 of strip 100. With the strips 100 and 102 adhered together as depicted in FIG. 4B, they are then structurally equivalent to the U-shape backing strip 60 depicted in FIG. 1C. Thus, a label strip 80, as aforediscussed, can be slid between the composite backing strip and the comb binding 20 as depicted in FIG. 4C.

In accordance with a still further alternative embodiment, attention is called to FIGS. 5A–C which depicts a different form of transparent backing strip 200. The backing strip 200 is elongated and box like in cross-section; that is, it includes legs 202,204 and front and rear cross-pieces 206 and 208. The front cross-piece 206 is intended to be secured directly to the rear face of the spine 22 of comb binding 20. This can be accomplished by utilization of a suitable adhesive applied between the spine rear face and the front face of backing strip cross-piece 206. Alternatively, the backing strip 200 can be affixed to the spine member 22 by simple rivets 218 passed through rivet openings 220 and 222 respectively formed in the front cross-piece 206 and spine member 22. With the backing strip 200 affixed to the comb binding 20 as depicted in FIG. 6, a label strip 80, identical to the aforedescribed label strip can be slid between and frictionally held in place between the backing strip and comb binding.

From the foregoing, it should now be appreciated that a backing has been described herein for giving comb bound reports a neat and professional looking appearance. The backing is preferably U-shaped to provide a more substantial squared-off look. The backing is preferably comprised of a transparent U-shape strip and a correspondingly shaped label strip intended to be frictionally retained between the transparent strip and the comb binding.

Although particular embodiments of the invention have been described herein, it is recognized that modifications and variations may readily occur to those skilled in the art. For example only, although preferred, it is not essential that the backing strip be U-shaped. Additionally, it is recognized that the title could be applied directly to the backing strip rather than using a transparent backing strip and separate label strip. Accordingly, it is intended that the appended claims be interpreted to cover all modifications and variations substantially equivalent to the embodiments specifically depicted herein.

I claim:

1. In combination:

a comb binding comprising an elongated spine member having front and rear faces and first and second edges and a plurality of spaced resilient fingers curling laterally from said first edge to substantially close against said front face adjacent to said second edge;

an elongated backing strip, said backing strip and spine member having substantially identical elongated dimensions;

said backing strip being formed to have a substantially box like open cross-section including spaced first and second side legs and spaced front and rear cross-pieces connecting said side legs, and wherein said rear cross-piece is formed of transparent material; and means attaching said backing strip front cross-piece to said spine member rear face.

2. The combination of claim 1 further including:

an elongated label comprised of flexible sheet material formed to have a substantially U-shape cross-section and dimensioned to be accommodated between said backing strip rear cross-piece and said spine member rear face.

3. In combination:

a comb binding comprising an elongated spine member having front and rear faces and first and second edges and a plurality of spaced resilient fingers curling laterally from said first edge to substantially close against said front face adjacent to said second edge;

an elongated backing strip, said backing strip and spine member having substantially identical elongated dimensions;

said backing strip having a substantially U-shape cross-section including first and second legs and a cross-piece, and wherein said cross-piece is formed of transparent material;

a first plurality of apertures formed in said backing strip first leg extending in a row therealong and spaced to correspond with the spacing between said resilient fingers;

a second plurality of apertures formed in said backing strip second leg extending in a row therealong and spaced to correspond with the spacing between said resilient fingers;

said resilient fingers extending through said first plurality of apertures and through said second plurality of apertures to thus mount said backing strip on said comb binding with said backing strip cross-piece extending parallel to and spaced from said spine member rear face.

4. The combination of claim 3 further including:

an elongated label comprised of flexible sheet material formed to have a substantially U-shape cross-section and dimensioned to be accommodated between said backing strip and said spine member rear face.

5. The combination of claim 3 wherein said backing strip is formed of first and second overlapping members adhered together.

* * * * *